United States Patent [19]

Hall et al.

[11] Patent Number: 4,822,212

[45] Date of Patent: Apr. 18, 1989

[54] SUBSEA TEMPLATE AND METHOD FOR USING THE SAME

[75] Inventors: Johnce E. Hall, Kingwood; Samuel L. Penny, Houston, both of Tex.

[73] Assignee: Amoco Corporation, Chicago, Ill.

[21] Appl. No.: 115,080

[22] Filed: Oct. 28, 1987

[51] Int. Cl.[4] ..... E21B 7/128; E21B 43/013; E02D 5/54; E02B 17/00

[52] U.S. Cl. ..... 405/227; 405/224; 166/359; 166/366

[58] Field of Search ..... 405/202, 204, 224, 227; 166/359, 366, 367

[56] References Cited

U.S. PATENT DOCUMENTS

| | | | |
|---|---|---|---|
| 3,643,446 | 2/1972 | Mott | 405/202 |
| 3,667,239 | 6/1972 | Mott | 405/202 |
| 3,708,985 | 1/1973 | Pogonowski et al. | 405/202 |
| 3,791,442 | 2/1974 | Watkins | 166/359 X |
| 4,058,137 | 11/1977 | de Saint Palais et al. | 405/224 X |
| 4,127,991 | 12/1978 | Regan | 405/202 |
| 4,137,722 | 2/1979 | Mossiossian et al. | 405/202 |
| 4,154,552 | 5/1979 | van Bilderbeek | 405/229 |
| 4,212,562 | 7/1980 | Stone et al. | 405/195 |
| 4,335,979 | 6/1982 | Stafford | 405/202 |
| 4,405,261 | 9/1983 | Lawson | 405/227 |
| 4,408,932 | 10/1983 | Cowan | 405/227 |
| 4,435,108 | 3/1984 | Hampton | 405/209 |
| 4,445,807 | 5/1984 | Cowan | 405/227 |
| 4,489,472 | 12/1984 | Cabrit et al. | 166/359 X |
| 4,537,533 | 8/1985 | Hampton | 405/227 |

OTHER PUBLICATIONS

Combustion Engineering brochure: "SG Wellhead System Product Improvements".

*Primary Examiner*—Randolph A. Reese
*Assistant Examiner*—John A. Ricci
*Attorney, Agent, or Firm*—Scott H. Brown; Fred E. Hook

[57] ABSTRACT

Subsea template and method for using the same. A subsea template includes a plurality of gimballed joints for receiving piles therethrough which are anchored in the sea floor. Also included are a plurality of gimballed joints for receiving well conductors therethrough. A template is lowered to the sea floor. The piles and well casings are inserted into their associated gimballed joints from a substantially vertical axis and when finally positioned, are fixedly connected to the gimballed joint associated therewith thus obviating the need for leveling the template.

16 Claims, 4 Drawing Sheets

SUBSEA TEMPLATE AND METHOD FOR USING THE SAME

BACKGROUND OF THE INVENTION

1. Field of the Invention

The present invention relates to a subsea template and method for using the same and more particularly to such templates and methods in which a template is used on a sea floor to install one or more well casings.

2. Setting of the Invention

In the drilling of offshore wells it is common to install a template on the sea floor over the formation into which a well is to be drilled. The template typically comprises a frame made up of tubing having several passageways therethrough. The template is typically fixedly connected to piles which are driven into the sea floor in order to secure the template. References herein to the "sea" floor and to "subsea" templates and the like should be taken to include references to any body of water in which an underwater well may be drilled.

When so secured, the template provides a means for spacing the various wellbores which are to be drilled into the formation and also supports the well casing and loads from the drilling riser and blowout preventer stack as well as other environmental loads during drilling and production.

Numerous prior art templates are provided which include means for leveling the template relative to a nonlevel sea floor. This is desirable in order for the template to properly receive the piles, conductors, drillstring and various risers, all of which approach the sea floor from a platform or floating vessel in a substantially vertical orientation.

Leveling equipment and techniques for subsea templates have greatly increased the cost of the templates and often involve the use of underwater divers or remote operated vehicles to accomplish template leveling.

In some instances, a template may be installed on a substantially level sea floor and conductors, piles, drill bits and the like may approach the template in a substantially nonvertical orientation due to drillstring bending of to the position of the platform from which the drillstring is lowered. In some cases, it would be desirable to lower the drillstring or casing string through the template in a nonvertical orientation in order to drill or case a slightly angled wellbore. Prior art templates are constructed to receive conductors, piles, drillstrings and the like at an angle substantially perpendicular to the template.

There exists a need for a template and method for using the same in which the template may be anchored to a sea floor without the need for leveling the same.

There exists a need for such a template and method for using the same in which drillstrings, casing strings and the like may be received through a template installed on the sea floor at angles other than substantially perpendicular to the template.

SUMMARY OF THE INVENTION

The instant invention comprises a template and method for using the same. The method includes the steps of lowering a template to the sea floor, pivotally coupling a pile to the template and inserting the pile into the formation. Thereafter, a well casing is pivotally coupled to the template and inserted into the formation.

The apparatus of the invention includes structure for performing the method.

DETAILED DESCRIPTION OF THE PREFERRED EMBODIMENT OF THE INVENTION

The present invention provides a subsea template and method for using the same. The template includes a frame for resting on a sea floor, means for pivotally coupling a pile to the frame which permits pile movement along a longitudinal axis thereof while the pile is so coupled and means for pivotally coupling a well casing to the frame which permits well casing movement along the longitudinal axis thereof while the well casing is so coupled. The template may be used to perform the method of the invention.

Figure 1:
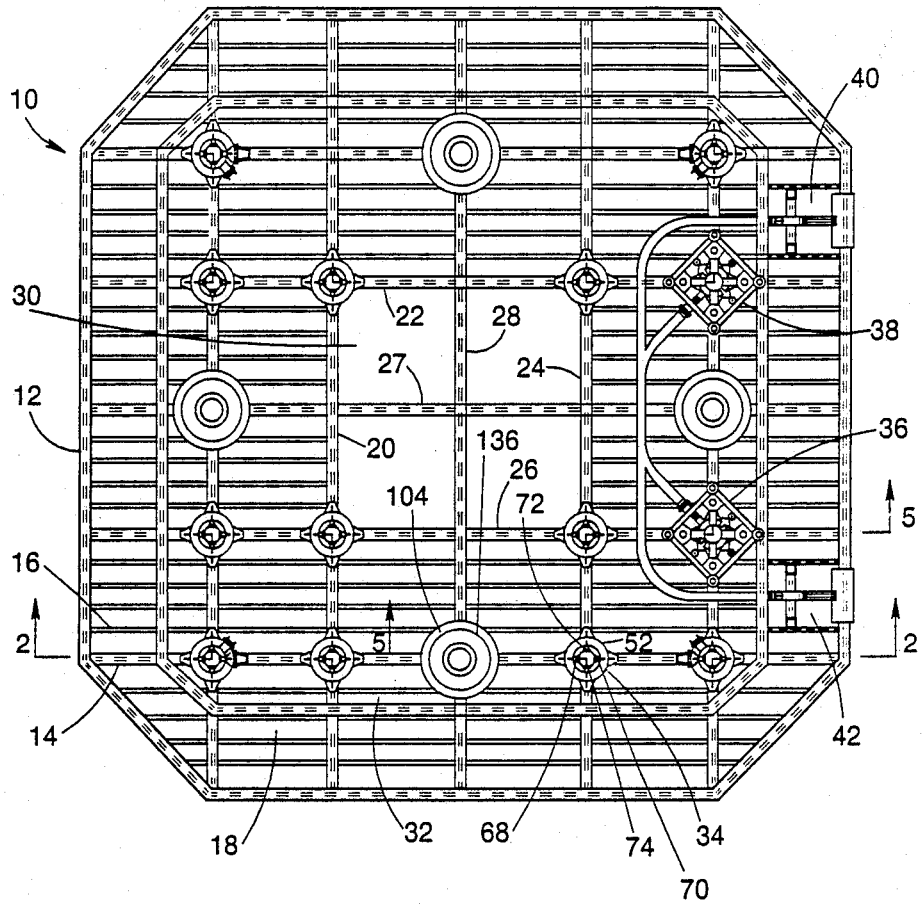
FIG. 1 is a top plan view of a template constructed in accordance with the instant invention.
Figure 2:
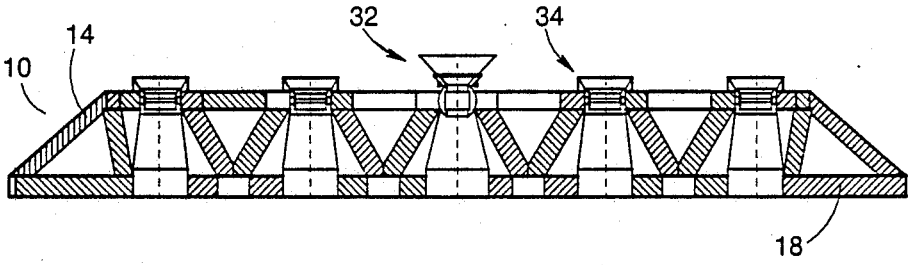
FIG. 2 is a view taken along line 2—2 in FIG. 1.

Turning now to FIG. 1, indicated generally at 10 is a template constructed in accordance with the apparatus of the instant invention. Template 10 includes a frame 12 made up of a plurality of beams, such as beams 14, 16. Beam 14 is a wide-flanged beam with such being indicated in the drawings by the dashed lines therealong. Each other beam in FIG. 1 having dashed lines therealong is also a wide-flanged beam.

A mud mat 18 comprises a plate affixed to the lower side of frame 12. The outer perimeter of the mud mat is the same as the outer perimeter of frame 12. The mud mat includes an inner perimeter which is substantially square shaped with the inner perimeter having sides 20, 22, 24, 26. Thus, the central portion of the template includes an opening 30 therethrough which is crossed by wide-flanged beams 27, 28.

Indicated generally at 32 is a pile bay. Also indicated generally, at 34, is a well bay. In FIG. 1, it can be seen that template 10 includes a total of four pile bays, like pile bay 32, each of which is substantially identical to pile bay 32. Template 10 includes a total of 14 well bays, like well bay 34, each of which is substantially identical to well bay 34.

Template 10 also includes a pair of sales riser bays indicated generally at 36, 38 and a related pair of flowline bays indicated generally at 40, 42, respectively.

Figure 3:
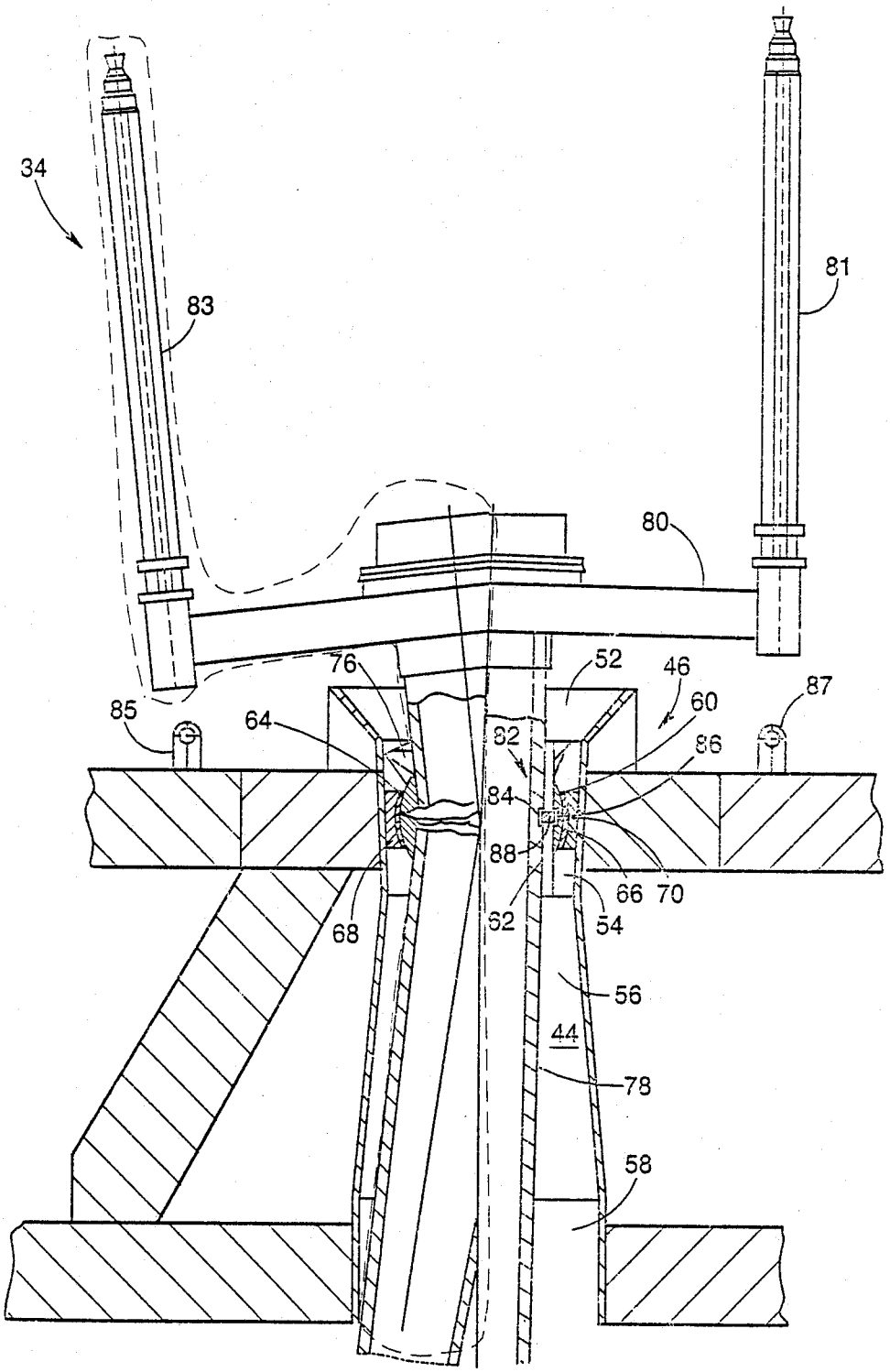
FIG. 3 is an enlarged view of a portion of the template of FIG. 2 including a conductor and permanent guide base frame with the conductor shown in several alternate positions.

For a more detailed view of well bay 34, attention is directed to FIG. 3. Included therein is a passageway 44 through the template in which a spherical bearing connector, indicated generally at 46, is received. Connector 46 and its associated structure, which will be hereinafter more fully described, is referred to herein as means for pivotally connecting a well casing to the frame. Passageway 44 is defined by a funnel portion 52, an upper cylindrical portion 54 (in which connector 46 is received), a frusto-conical portion 56, and a lower cylindrical portion 58.

Connector 46, such also being referred to herein as a second gimballed joint, comprises a spherical bearing 60 having a substantially cylindrical opening 62 therethrough. Bearing 60 is supported by a bearing race comprised of four arcuate portions, two of which are portions 64, 66 in FIG. 3. Each of arcuate portions 64, 66 are supported by studs 68, 70 which are in turn fixedly connected to the template frame. Studs 68, 70 are also viewable in FIG. 1. A second pair of studs 72, 74 supports additional portions, like portions 64, 66, which make up, in combination with portions 65, 67 (not shown), the race that supports the bearing. As can be seen in the view of FIG. 1, each arcuate portion of the bearing race defines an arc of approximately 30°.

A funnel 76 is mounted on the upper portion of bearing 60 about the circumference of opening 62.

In the view of FIG. 3, well bay 34 is shown with a conductor 78 installed therethrough. Conductor 78 is also referred to herein as a well casing.

Conductor 78 includes a commercially available permanent guide base 80 mounted on the upper end thereof. The right side portion of conductor 78 and guide base 80 is shown (in solid lines) in a substantially vertically upright position. The upper left side portion of conductor 78 and guide base 80 is shown (in dashed lines) in their most counter-clockwise (in the view of FIG. 3) position while the lower portion of conductor 78 on the left side is shown (in dot-dash lines) in its most clockwise (in the view of FIG. 3) position. A line which defines the longitudinal axis of conductor 78 is shown for each of the three positions. It is to be appreciated that conductor 78 and guide base 80 are substantially symmetrical with respect to the longitudinal axis thereof.

As can be seen in the dot-dash line position of casing 78, the left hand side of conductor 78 strikes the lowermost portion of the template thereby limiting pivotal movement of bearing 60. The side of the conductor will strike the lowermost portion of the template regardless of the direction of pivoting and will thus limit the range through which the bearing pivots.

Indicating generally at 82 is means for fixedly connecting the well casing to the well casing coupling means, such being also referre to herein as means for fixing the casing to the second joint. Included therein is an annular groove 84 formed about the radially inner circumference of opening 62 in bearing 60. A second annular groove 86 is formed on the radially outer surface of conductor 78 about the circumference thereof. Grooves 84, 86 are of substantially the same height. A spring collar 88 comprises an arcuate collar spanning an arc of about 300° having a cross section as shown in the view of FIG. 3. When the components of fixing means 82 are in the configuration shown in FIG. 3, spring collar 88 is received partially in each of grooves 84, 86 and thus locks conductor 78 against axial movement relative to opening 62 in bearing 60.

Guide base 80 includes a pair of opposing upright arms 81, 83 each having a longitudinal bore therethrough. As will later be more fully explained, as can best be seen in the view of FIG. 5, lines attached to lugs 85, 87 (which are fixedly mounted on the upper portion of the template) serve to guide conductor 78, with guide base 80 mounted on the top thereof, into well bay 34.

Figure 4:
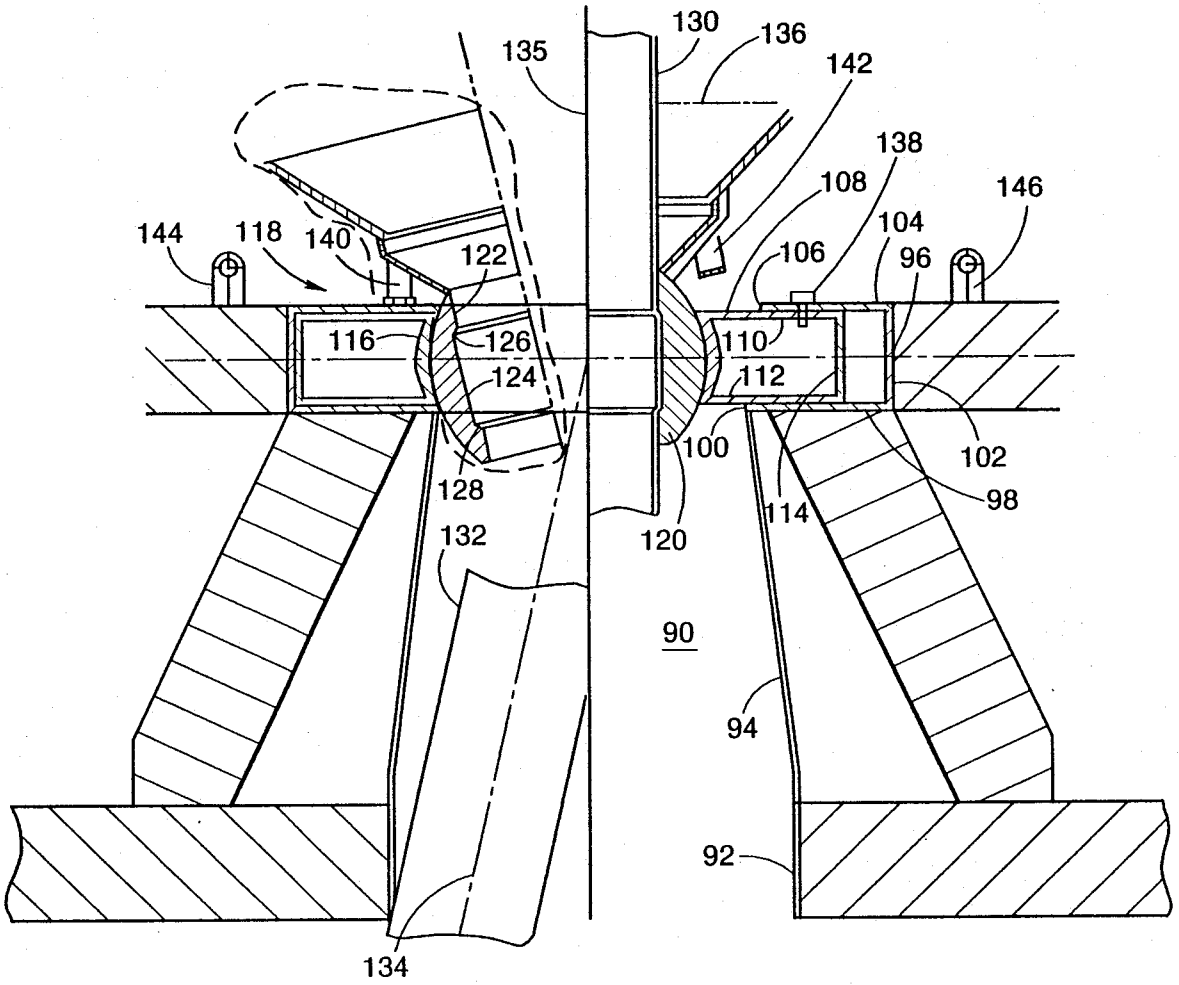
FIG. 4 is an enlarged view of a portion of the template of FIG. 2 including a pile shown in several alternate positions.

Turning now to FIG. 4, consideration will be given in greater detail to the structure comprising pile bay 32. Included therein is a passageway 90 formed through the template. Passageway 90 includes a lower cylindrical portion 92, a frusto-conical central portion 94 and an upper portion 96 which defines an annular space centered on the longitudinal axis of passageway 90. Portion 96 is defined by a lower annular plate 98 having a circular inner perimeter 100, an upright cylindrical portion 102 and an upper annular plate 104 having a circular inner perimeter 106. Plate 104 is also viewable in FIG. 1.

Received within annular portion 96 is an annular bearing support 108. Bearing support 108 includes an upper annular plate 110, a lower annular plate 112, and an upright cylindrical portion 114 which connects the outer perimeters of upper and lower annular plates 110, 112. A substantially annular bearing race 116 connects the radially inner perimeters of each of plates 110, 112 and serves to support a spherical bearing connector indicated generally at 118. Connector 118 and its associated structure, which will be hereinafter more fully described, is referred to herein as means for pivotally connecting a pile to the frame. Bearing connector 118, such being also referred to herein as a first gimballed joint, includes therein a spherical bearing 120 having a substantially cylindrical opening 122 therethrough. Opening 122 includes therein an annular groove 124 having an upper shoulder 126 and a lower shoulder 128.

It is to be appreciated that bearing race 116 is not constructed to provide support about its 360° circumference but rather is broken into a plurality of arcuate bearing supports similar to those supporting bearing 60 in well bay 34.

The right side of connector 118 is shown (in solid lines) with a pile 130 received therethrough and with the connector and pile in a substantially vertical position. Pile 130 comprises an elongate cylindrical tube having its lower end received in the formation beneath the template as will hereinafter be more fully described. The left side of connector 118 is shown (in dashed lines) in its most counter-clockwise (in the view of FIG. 4) position. A lower end 132 of pile 130 is shown (in dot-dash lines) in the position it assumes when connector 118 is in its most clockwise (in the view of FIG. 4) position with the longitudinal axis of pile 130 being designated by line 134 when so positioned.

The right side of bearing support 108 is shown (in dashed lines) positioned within annular portion 96 coaxial with longitudinal axis of passageway 90, such being designated by line 135, As will hereinafter be more fully explained, the template is positioned on the sea floor and pile 130 is installed therein with bearing support 108 being pinned via pins, like pin 138, in its coaxial position. The left side view of connector 118 is shown with the pins removed or sheared off and with bearing support 108 translated to its leftmost position. The need for such will be hereinafter more fully explained in connection with the description of the method for using the template.

Finishing now the description of FIG. 4, a pair of rotation stops 140, 142 are mounted on the lower surface of either side of funnel 136. As can be seen in the left side view, stop 140 abuts against the upper surface of plate 104, as shown in FIG. 4, or against the top surface of plate 110 when bearing support 108 is in its coaxial position in order to stop counter-clockwise (in the view of FIG. 4) rotation of the connector 118. In a similar fashion, stop 142 provides a limit to clockwise (in the view of FIG. 4) rotation of the connector 118. In a similar fashion, stop 142 provides a limit to clockwise (in the view of FIG. 4) rotation of the connector. A pair of lugs 144, 146 are mounted on the upper portion of the template and provide anchors for guidelines (not shown) which are used in connection with lowering pile 130 into and through connector 118 as will later be more fully described.

Figure 5:
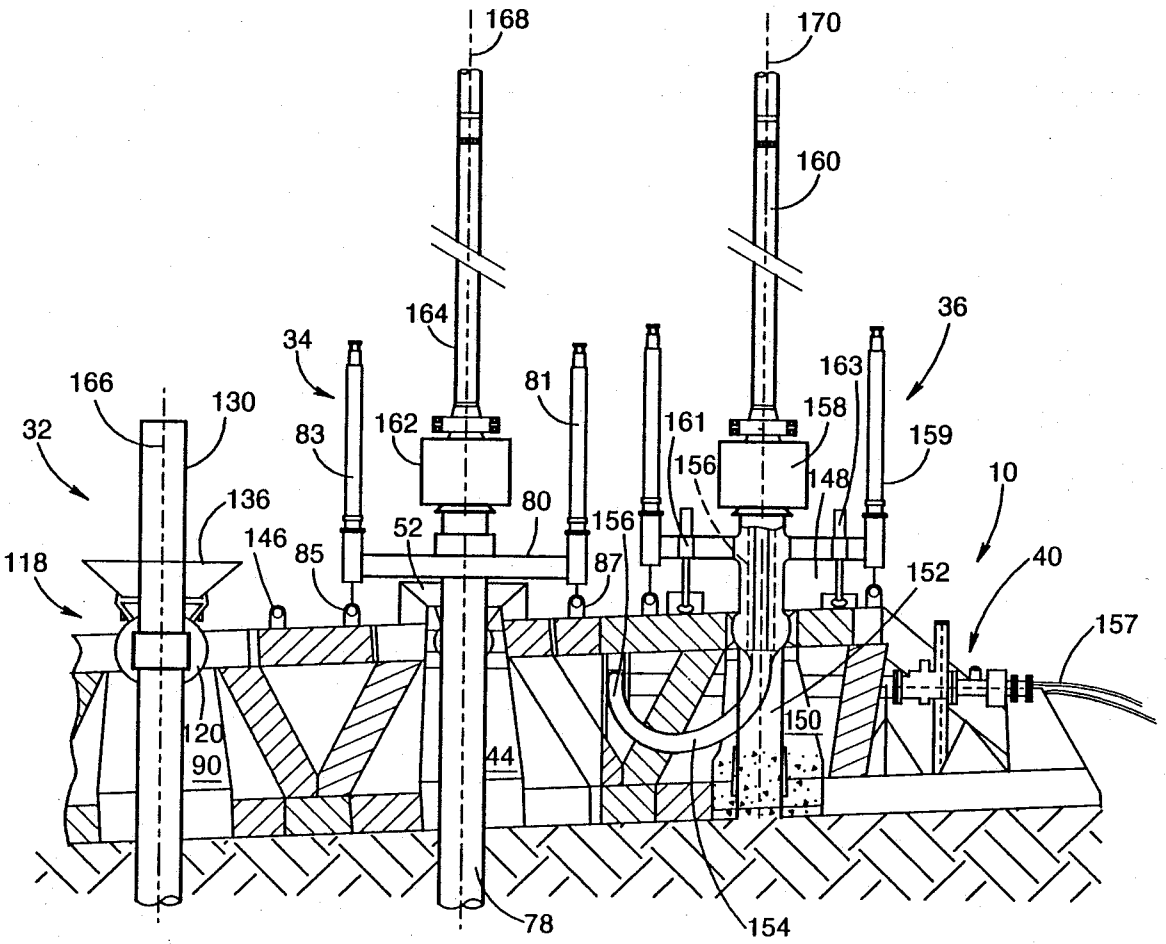
FIG. 5 is a view taken along line 5—5 in FIG. 1 after well completion and installation of production and sales risers.

Turning now to FIG. 5, template 10 is shown in its installed condition and after completion of a well in well bay 34. Sales riser bay 36 includes therein a spherical bearing connector 148, such being similar in structure and operation to connector 46. A passageway 150 formed through the template, in a fashion similar to passageways 44, 90, receives therein a grout tube 152 which is rigidly attached to the lower end of connector 148. A conduit 154 is received through the wall of passageway 150 and has one end attached to a conduit 156, which is mounted on the template, and the other end attached to the lower end of connector 148 in communication with an axial bore therethrough. The other end of conduit 156 is in communication with a flowline 157 which is connected to a pipeline (not shown) to which the produced fluids are provided via flowline 157. A commercially available permanent guide base 159 is mounted on connector 148 and serves the same function as guide base 80. Commercially available screw jacks 161, 163 may be used to level guide base 159 as will be later explained in connection with the description of the operation of the template.

A commercially available wellhead 158 is mounted on connector 148 and is in communication with one end of sale riser 160 which has the other end thereof in communication with a production platform at the surface of the water.

In a similar fashion, a commercially available wellhead 162 is mounted on guide base 80. One end of a production riser 164 is in communication with the wellhead and the other end thereof is in communication with equipment on the platform at the surface. Axes 166, 168, 170 define the longitudinal axes of pile 130, conductor 78 (and riser 164) and riser 160, respectively.

In operation, template 10 is lowered to the sea floor by a crane barge construction vessel or semisubmersible drilling rig. In the instant embodiment of the invention, template 10 weighs approximately 450 tons and thus use of the crane barge construction vessel to lower the same is preferred.

When the template is at rest on the sea floor, it may not be substantially parallel but rather may be disposed at an angle as shown in FIG. 5. After the template is at rest on the sea floor, each of the four piles, like pile 130, is installed in order to firmly anchor the template. Lines (not shown) on lugs 144, 146 which extend from the template to the surface act as guides for pile 130 and for the pipe string from which the pile is suspended and serve to bring the lower end of the pile into funnel 136. The lower end of pile 130 is guided into connector 118 through funnel 136. The pile approaches well bay 34 in a substantially vertical position, i.e., along axis 166 in FIG. 5. The lower end of the pile is guided into opening 122 by funnel 136. The axis of opening 122 tends to align with the axis of the pile due to the action of the lower end of the pile against the sides of the funnel as the same is lowered. When the same are aligned, the pile is lowered through the opening, through passageway 90 and into the formation beneath the template as shown in FIG. 5. The weight of the pile and pipe string will initially drive the pile into the bottom. Thereafter, water may be circulated through the pipe string in order to erode the formation beneath the pile thereby further embedding the same in the floor beneath the template.

A commercially available hydraulic hammer may also be used to install pile 130 in which case the lower end of the pile also approaches connector 118 along axis 166 and is received therein as described above.

After the pile is firmly embedded in the formation beneath the template, the means for installing the same is removed and commercially available hydraulic equipment (not shown) is inserted into pile 166 and lowered in the pile until the same is received within opening 122. The equipment is used to radially expand that portion of the pile adjacent groove 124 thereby expanding the same into the groove as shown on the right side view of FIG. 4. Such expansion locks the pile against axial movement along axis 155 in FIG. 5.

Each of the other piles are installed in a similar fashion. When so installed, the piles act to transfer loads on the template to the formation therebeneath.

After the piles are installed, casing 78 with permanent guide base 80 mounted thereon, is lowered until the lower end of the conductor is received within funnel 52. Arms 81, 83 of guide base 80 are received over lines (in FIG. 5) which are anchored to lugs 85, 87 on the template. The lines guide the conductor so that the lower end is received within funnel 52. Funnel 52 guides the lower end of the conductor toward funnel 76 on bearing 60. Conductor 78 approaches the template along substantially vertical axis 168. As the lower end strikes funnel 76, it tends to rotate bearing 60, thereby aligning the axis of opening 62 with the axis of the approaching conductor.

Spring collar 88 is received in groove 86 on conductor 78. As the conductor is jetted into the formation beneath the template, the spring collar approaches bearing 60. As the spring collar is received into funnel 76 and approaches opening 62, the same is compressed into groove 86 on the conductor thereby permitting the collar to be received within opening 62. When the collar is adjacent groove 86 in bearing 60, it expands partially into groove 86 and assumes the position in FIG. 3 thereby locking conductor 78 against vertical movement along the axis of opening 62.

After the conductor is so installed, drilling the wellbore begins. The drilling equipment is guided to and through connector 78 via the guidelines extending from guide base 80. After the well is completed in the usual fashion, riser 164 and riser connector 162 are lowered into position, using the guidelines to seat the same on wellhead located inside guide base 80.

Well conductors are inserted into each well bay in which a well is to be drilled, the well is completed and risers are installed in the same fashion as described in connection with well bay 34.

Screw jacks 161, 163 on the sales riser guide frame are used to level the guide frame. Thereafter, grout (shown in FIG. 5) is pumped into passageway 150 thereby permanently fixing connector 148 relative to the template. The sales riser 160 is installed in the same fashion as the production risers.

When installed and completed as described above, production from each of the wells is piped to the surface platform. Thereafter, such production is pumped into sales riser 160, through conduit 154 and into flow line 157 for transport to the pipeline. The other sales riser and associated equipment also receive production from the platform and provides the same to the pipeline in a similar fashion.

It can thus be seen that the instant invention provides a template having gimballed joints for receiving both well conductors and piles which enables use of the template on uneven surfaces without the expensive equipment and leveling procedures necessary in connection with prior templates. Moreover, it should be noted that because of bending of pipe strings lowered from the surface and the like that even when a template is substantially level, piles and conductors may approach the same from somewhat nonvertical angles. With the template of the invention, the spherical guide bearings are rotated under action of the lower end of the pile or conductor against the funnel into which the same is guided, thereby aligning the bearing opening to receive the pile or conductor.

In the event that leveling should be deemed necessary due to extreme floor slope, drilling of slant wells or the like, after driving the piles, like pile 130, into the formation and before locking the piles to their associated bearings, one end of the template may be raised to bring the template to a more level orientation. Since each pile is closely received within its associated bearing opening, the pins, like pin 138 in FIG. 4, which fix the bearing supports, like support 108, in a coaxial position relative to the passageway, like passageway 90, through which each pile is received are sheared to permit lateral shifting of the bearing supports. After the template is oriented as desired, each pile is fixed to its bearing and well drilling may commence as described.

Since each pile and conductor are closely received through their associated bearing opening, lateral loading of the template, risers and the like is transferred to the piles and thus to the formation. Since the piles and conductors are axially fixed relative to their associated bearings, axial loading of the template, risers and the like is also transferred to the piles. Such load transfer provides a very stable base, the template, from which drilling and other operations may be conducted.

It is to be appreciated that additions and modifications may be made to the instant embodiment of the invention without departing from the spirit thereof which is defined in the following claims.

We claim:

1. A method for installing a well casing in a formation beneath a body of water comprising the steps of:

lowering a template to the floor of the body of water;

pivotally coupling a pile to the template;

inserting the pile into the formation;

pivotally coupling a well casing to the template in a manner which permits well casing movement along the longitudinal axis of the well casing while permitting well casing pivoting in all directions; and inserting the well casing into the formation.

2. The method of claim 1 wherein said method further includes the step of fixing the pile to the template.

3. The method of claim 1 wherein said method further includes the steps of fixing the well casing to the template.

4. The method of claim 1 wherein the step of pivotally coupling a pile to the template comprises the step of coupling the pile to the template in a manner which permits pile movement along the longitudinal axis of the pile while permitting pile pivoting in all directions.

5. The method of claim 4 wherein the step of permitting pile pivoting in all directions comprises the step of permitting pile pivoting in all directions within a predetermined angular range.

6. The method of claim 1 wherein the step of permitting well casing pivoting in all directions comprises the step of permitting well casing pivoting in all directions within a predetermined angular range.

7. A template for installing a well casing in a formation beneath a body of water comprising:

a frame for resting on the floor of the body of water;

means for pivotally coupling a pile to said frame, said pile coupling means permitting pile movement along the longitudinal axis thereof while said pile is so coupled; and means for pivotally coupling a well casing to said frame, said well casing coupling means permitting well casing movement along the longitudinal axis thereof while said well casing is so coupled.

8. The template of claim 7 wherein each of said coupling means is constructed and arranged to permit pivoting in all directions.

9. The template of claim 8 wherein said template further includes means for fixedly connecting said pile to said pile coupling means.

10. The template of claim 8 wherein said template further includes means for fixedly connecting said well casing to said well casing coupling means.

11. The template of claim 8 wherein such pivoting in all direction is limited to a predetermined angular range.

12. A template for use on a natural floor on a body of water comprising:

a substantially planar frame having a pair of passageways therethrough;

a first gimballed joint received in one of said passageways, said joint having an opening therethrough for receiving a pile therein, said pile being pivotable in all directions when it is so received;

a second gimballed joint received in the other of said passageways, said second joint having an opening therethrough for receiving a well casing therein, said well casing being pivotal in all directions when it is so received;

means for fixing said pile to said first joint comprising: an annular groove formed on the radially outer received in said groove, and an annular groove formed on the radially inner sufrace of said second joint opening, sad spring collar being compressible into said well casing groove as said spring collar is lowered into said second joint opening and expanding partially into said opening groove when said collar is adjacent thereto; and means for fixing said well casing to said second joint.

13. The template of claim 12 wherein said template further includes a funnel mounted on said template about the perimeter of the passageway in which said second joint is received for guiding one end of said well casing toward said second joint.

14. The template of claim 12 wherein said template further includes a funnel mounted on said second joint about the perimeter of said opening for guiding one end of said well casing into said opening.

15. The template of claim 12 wherein said template further includes means for limiting gimballed joint pivoting to a predetermined angle from the vertical axis of the passageway in which said joint is received.

16. The template of claim 12 wherein said template further includes means for laterally shifting said first gimballed joint.

* * * * *

UNITED STATES PATENT AND TRADEMARK OFFICE

CERTIFICATE OF CORRECTION

PATENT NO. : 4,822,212

DATED : April 18, 1989

INVENTOR(S) : Johnce E. Hall, Samuel L. Penny

It is certified that error appears in the above—identified patent and that said Letters Patent is hereby corrected as shown below:

Column 5, line 18, after "bore" and before "therethrough", insert --155--.

Claim 12, Column 8, lines 43-44, after "outer" and before "received", insert --surface of said well casing, an arcuate spring collar--.

Signed and Sealed this

Nineteenth Day of June, 1990

*Attest:*

HARRY F. MANBECK, JR.

*Attesting Officer*

*Commissioner of Patents and Trademarks*